US005386946A

United States Patent [19]

Fetzer

[11] Patent Number: 5,386,946

[45] Date of Patent: Feb. 7, 1995

[54] FLAKING MILL WITH A PRODUCT CHANNEL ON EACH OF THE AXIAL ENDS OF THE ROLLERS

[75] Inventor: Wilhelm Fetzer, Niederuzwil, Switzerland

[73] Assignee: Buhler AG, Uzwil, Switzerland

[21] Appl. No.: 182,821

[22] Filed: Jan. 18, 1994

[30] Foreign Application Priority Data

Jan. 20, 1993 [CH] Switzerland ..... 00159/93

[51] Int. Cl.[6] ..... B02C 25/00; B02C 4/28

[52] U.S. Cl. ..... 241/34; 241/224; 241/226

[58] Field of Search ..... 241/33, 37, 135, 34, 241/224, 225, 226

[56] References Cited

U.S. PATENT DOCUMENTS

| | | | |
|---|---|---|---|
| 315,897 | 4/1885 | Brewer et al. | 241/226 X |
| 1,961,291 | 6/1934 | Guillo | 241/226 |
| 2,060,868 | 11/1936 | Hollstein | 241/226 |
| 2,063,363 | 12/1936 | Brasington | 241/226 |
| 2,808,215 | 10/1957 | Bosshard | 241/226 |
| 4,839,494 | 6/1989 | Jakobs | 241/226 |
| 4,905,917 | 3/1990 | Fetzer et al. . | |

FOREIGN PATENT DOCUMENTS

| | | | |
|---|---|---|---|
| 0271828 | 6/1987 | European Pat. Off. . | |
| 404656 | 12/1990 | European Pat. Off. | 241/226 |

OTHER PUBLICATIONS

"Sacol Hyacs Hydraulic Actuators Fitted with 100 Micron Displacement Transducer" p. 11.

*Primary Examiner*—Timothy V. Eley
*Attorney, Agent, or Firm*—Sandler Greenblum & Bernstein

[57] ABSTRACT

A roll mill, particularly a flaking mill with a product channel on each of the axial ends of the rollers utilizes at least two rollers having guide channels with adjoining guide surfaces, at their axial ends, with the guide channels and guide surfaces, conveying the product to be milled into the converging gap or nip of the rollers. The guide surfaces are pivotable via a piston-cylinder unit from an operating position into a discharge position where in the latter position, foreign objects which have accumulated on the guide surface are removed via an open flap, below the guide surface, into a container.

20 Claims, 7 Drawing Sheets

FLAKING MILL WITH A PRODUCT CHANNEL ON EACH OF THE AXIAL ENDS OF THE ROLLERS

CROSS REFERENCE TO RELATED APPLICATIONS

This application claims the priority of Swiss Application No. 00 159/93-0, filed 20 Jan. 1993, the disclosure of which is incorporated herein by reference in its entirety.

BACKGROUND OF THE INVENTION

1. Field of the Invention

This invention pertains to a roll mill, and in particular to a flaking mill for milling particulate material having at least two rollers that are pressed against one another by means of a pressure device, with each of the axial ends of the rollers having a product channel arranged relative thereto, with an inclined guide surface thereof being adapted to bring the product to be milled, Which tends to extend beyond the axial length of the rollers, back to the converging gap of the rollers.

2. Discussion of the Background of the Invention and Material Information

U.S. Pat. No. 4,905,917 and cognate European Patent EP 0271828, also assigned to the assignee of the present invention, discloses a roll mill in which product guides or guide channels are utilized on both ends or edges of the rolls which serve to return the product to be milled, that flows outwardly towards the ends of the rolls, back into the grinding gap.

In addition it is known that the product that is fed into the grinding gap, respectively the converging gap or nip between the rolls, which is not directly pulled into the gap, has a tendency to flow toward the ends of the rolls, so that predominately clumps and coarse particles etc. in the product, which are in a granulatory manner substantially larger than the product itself, and therefore cannot be gripped by the grinding nip, according to the noted tendency, arrive at the ends of the rolls.

Roll mills, which were already the state of the art with reference to prior art U.S. Pat. No. 4,905,917, were so constructed that the roll ends had no frusto-conical tapered or bevelled ends so that the side edges or surfaces of the rolls closely adjoined the side edges of the roll mill, so that the product could flow up to the side edges of the roll mill, with the result that the noted clumps or other coarse particles were kept in motion at the roll ends until they were worn down to size which permitted entry into the grinding gap. At the time of such entry, these particles are however still larger than the granulations of the product, that is the deformation forces are greater, which is also the case with the surface loading upon the rolls. Such loads can cause damage to rolls, particularly when this condition occurs at the roll edges. This results in break out portions at the roll ends or edges.

In order to at least partially avoid the resulting differing grinding conditions, it was already suggested in U.S. Pat. No. 4,905,917 to provide a frusto-conical taper at the roll ends, on which a guide surface adjoins that prohibits that the noted coarse parts can bypass the rolls, via the channel formed by the taper at the ends of the rolls, without being milled.

While these tapers or chamfers have the advantage that while the noted clumps or other coarse particles remain in this area without damaging the rolls, it is however a disadvantage that the material flow is disturbed.

SUMMARY OF THE INVENTION

It is the object or goal of this invention to eliminate the noted disadvantage which is accomplished by the inventive combination of the roll mill of this invention wherein a roll mill, especially a flaking roller mill for granular material, comprises at least two rollers, the rollers being pressed against one another by means of a pressure device, with each of the axial ends of the rollers, having arranged, opposite to the frontal areas of the rollers, a product channel, with each of the product channels having an inclined guide surface so that the granular material, which tends to extend beyond the axial length of the rollers is brought back to a converging gap between the rolls, wherein the guide surfaces form a portion of a movable rocker arm so that the guide surfaces are movable from an operating position into a discharge position and back into the operating position.

In one embodiment of the roll mill of this invention, the product channel is stationary and the rocker arm is pivotable and adjoins the product channel.

In another embodiment of the roll mill of this invention, the product channel is stationary and the rocker arm is elastically deformable and adjoins the product channel.

In a further embodiment of the roll mill of this invention, the product channel and the rocker arm are constructed as a single unit and are so movable as a unit that the guide surface is pivotable from the operating position to the discharge position.

In yet another embodiment of the roll mill of this invention, the guide surface forms a portion of a guide roll, with the guide roll being rotatable on the product channel and being pivotable, together with the product channel from the operating position to the discharge position and back to the operating position.

A yet further embodiment of the roll mill of this invention further includes a pivotable flap, the flap being arranged below the product channel, means for controlling and actuating the pivotable flap so that the flap is in an operating position when the guide surfaces are also in the operating position and is pivotable into a discharge position when the guide surfaces are also in the discharge position, to thereby remove coarse impurities on the guide surfaces, from the roll mill by means of the flap.

Yet a further embodiment of the roll mill of this invention includes means for pivoting the rocker arm and respectively the guide surfaces into the operating position and into the discharge position, said pivoting means taking the form of a single acting cylinder including an internal pressure spring, with the spring maintaining the guide surfaces in the operating position.

A further embodiment of the roll mill of this invention includes a control system having a timer for controlling the means for pivoting, with the pivot means actuating the rocker arm, at predetermined time intervals from the operating position into the discharge position.

A final embodiment of the roll mill of this invention includes a control system for controlling the means for pivoting, a strain gage is provided on the guide surface, with the strain gauge being operatively connected with the control system and providing a signal to the control system when coarse impurities of a minimal weight are present on the guide surface, with the control system, as a result of such a signal, causing the means for pivoting to pivot the guide surfaces from the operating position into the discharge position.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
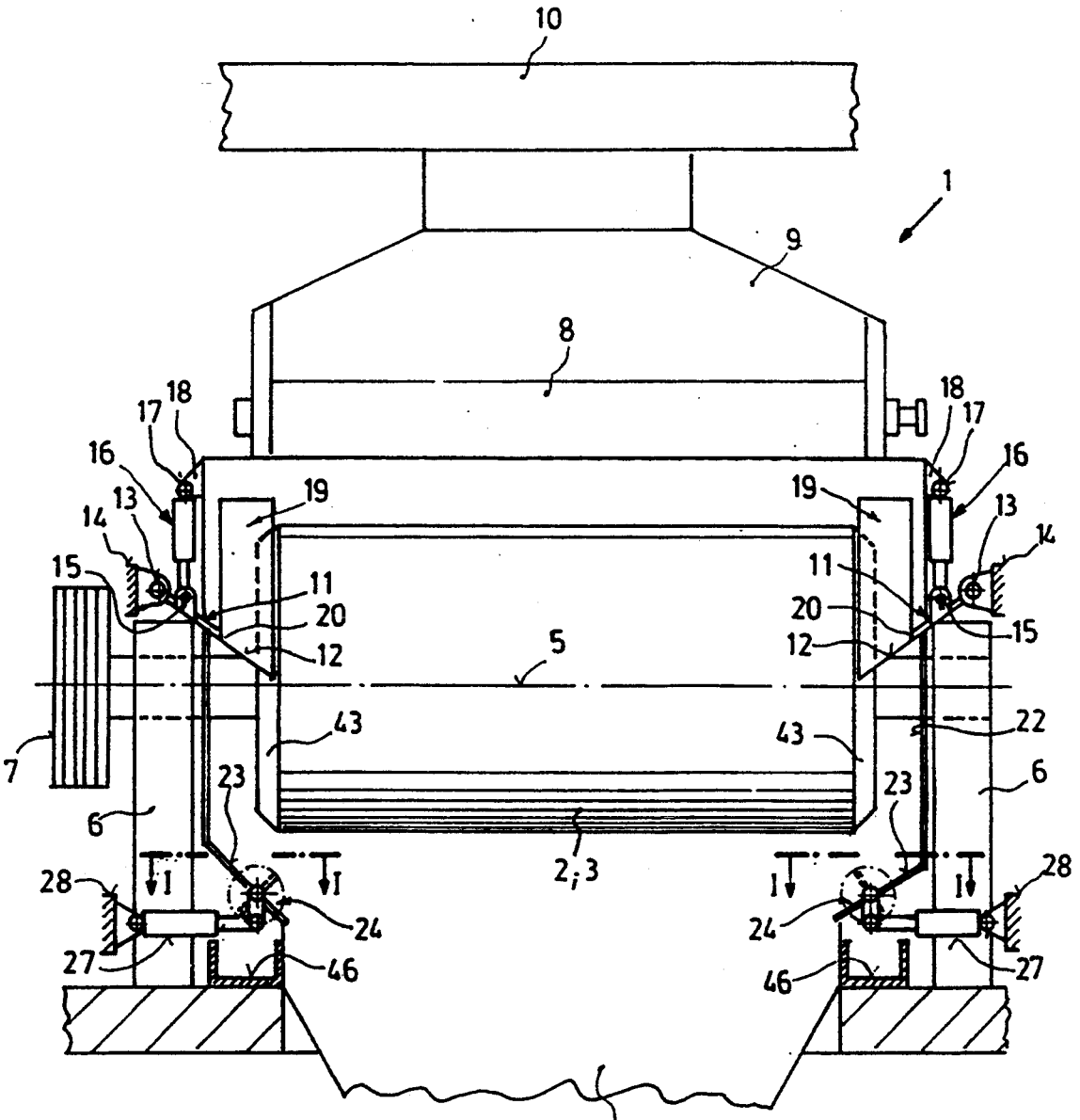
FIG. 1 is a cross-section through the roll mill of the present invention, with the roll mill being shown partially schematically.

A roll mill according to FIG. 1 comprises a roll pair having rolls or rollers 2 and 3 (see FIGS. 3 and 4), with FIG. 1 only showing roll 2. Both rolls rotate about an axis of rotation 5 and are rotatably journalled in a bearing carrier or retainer 6 and are driven via a drive sheave 7 (only one of which is shown) or via a drive sheave and a transmission (not shown) of any desired conventional type.

The products to be milled or worked (hereinafter referred to as "product or products") by the rolls, for example grain, kernels, seeds or granules, etc., which for example must be flaked or rolled, are fed into the rolls via a feed roll 8 which in turn obtains the product from a product distributor 9.

The supply of the product into the roll mill and thereby into the product distributor is achieved via a product supplier or a conveyor 10, for example via mechanical supply means.

Figure 3:
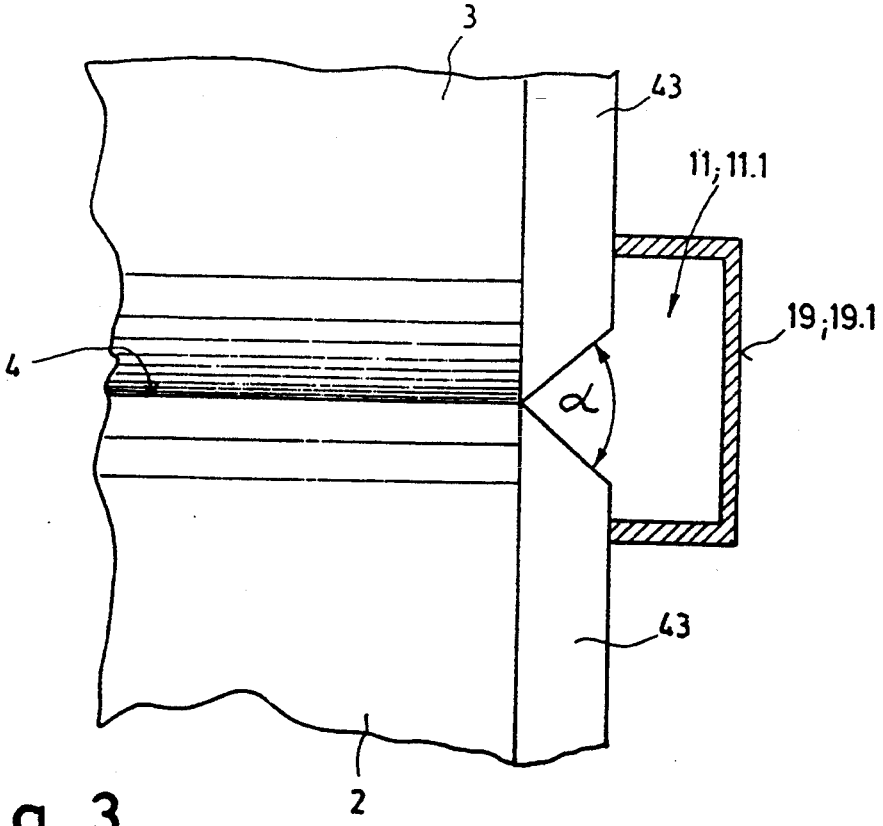
FIGS. 3 and 4 each show a detail of the roller mills of FIGS. 1 and 2 respectively in a cutaway form and in a top plan view relative to the rollers.
Figure 4:
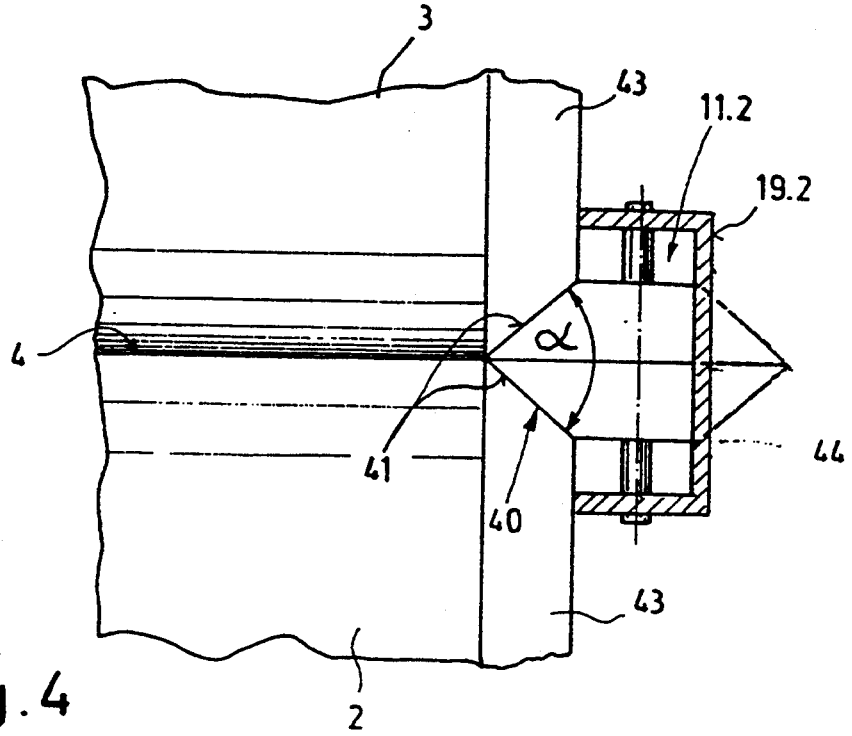

Rolls 2 and 3, at their sides or edges, have frusto-conical, tapered ends 43, which, as shown in FIGS. 3 and 4, provide a channel with an aperture angle $\alpha$ of about 6°–100°, preferably of about 90°, through which channel the product could pass unchanged past the roll sides if the rocker arm 11 and associated guide surface 12 of the present invention would not close off the discharge passage therethrough.

However, in order to permit the passage of the already mentioned clumps or other coarse particles which accumulate on guide surface 12 and which are not engaged or enter into the roll gap 4 (also sometimes referred to as grinding gap), rocker arm 11 is pivotally journalled via a pivot bearing 13.

A piston-cylinder unit 16, which is attached on the piston portion, via a pivot axis 15, with rocker arm 11 and on the piston portion, via a pivot bearing 17, with a stationary housing portion 18, provides the force to press or bias rocker arm 11 against a stop member 20 which in turn is a portion of a stationary guide channel 19.

By means of the noted stop 20, guide surface 12 is situated exactly so that the previously noted channel, having the aperture angle $\alpha$, is kept closed until the previously noted discharge is desired, without however directly touching the ends of the rolls.

As will be discussed in more detail later, with reference to FIG. 5, the piston-cylinder 16 can be a single acting cylinder with a pressure or compression spring 21 which provides the force by means of which rocker arm 11 is biased against stop member 20.

The product guide or guide channel 19, as best seen in FIG. 3, is shaped as a channel and has as its purpose that the product, which is supplied via the sides or edges of rolls 2 and 3 is conveyed, via guide surface 12, back into grinding gap 4.

A stationary end plate 22 is provided between bearing retainer 6 and the respective sides of rolls 2 and 3, with end plate 22 being a part of a housing which surrounds these rolls. The lower end of end plate 22 includes an angled guide member 23 in which a rotary flap or gate 24 is provided, whose function will be described hereinafter.

Figure 1A:
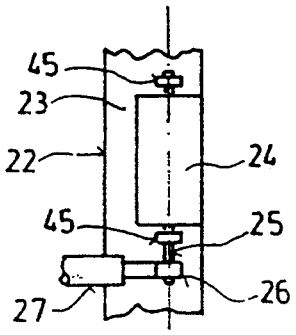
FIGS. 1*a* and 1*b* are each a cutaway portion of FIG. 1 taken along lines 1*a*—1*a* and 1*b*—1*b*, respectively.
Figure 1B:
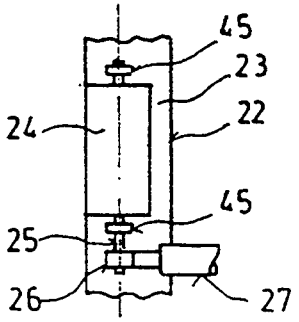

Rotary flap 24 is rotatably journalled in a bearing body 45 via a pivot shaft 25 (see FIGS. 1*a* and 1*b*), with rotary flap 24, in turn, being contained in angled guide member 23. The rotation or pivoting of flap 24 is achieved, as shown in FIG. 5, by means of a pivot lever 26 attached to pivot shaft 25, with pivot lever 26 also being pivotally connected with a piston-cylinder unit 27, which in turn is pivotally journalled at a stationary housing portion 28.

As can be seen in FIG. 1, at the ends of rolls 2 and 3, the product guides 19, as well as rocker arms 11 with all the described items associated therewith, are arranged in mirror-image or allochiral fashion.

In FIG. 1, rotary flap 24 is shown in solid lines in its closed position and in broken lines in its open position. The product which flows through opened rotary flap 24, when rocker arm 11 is pivoted downwardly, is retained in collector pan or retainer 46 which is located below rotary flap 24.

Figure 2:
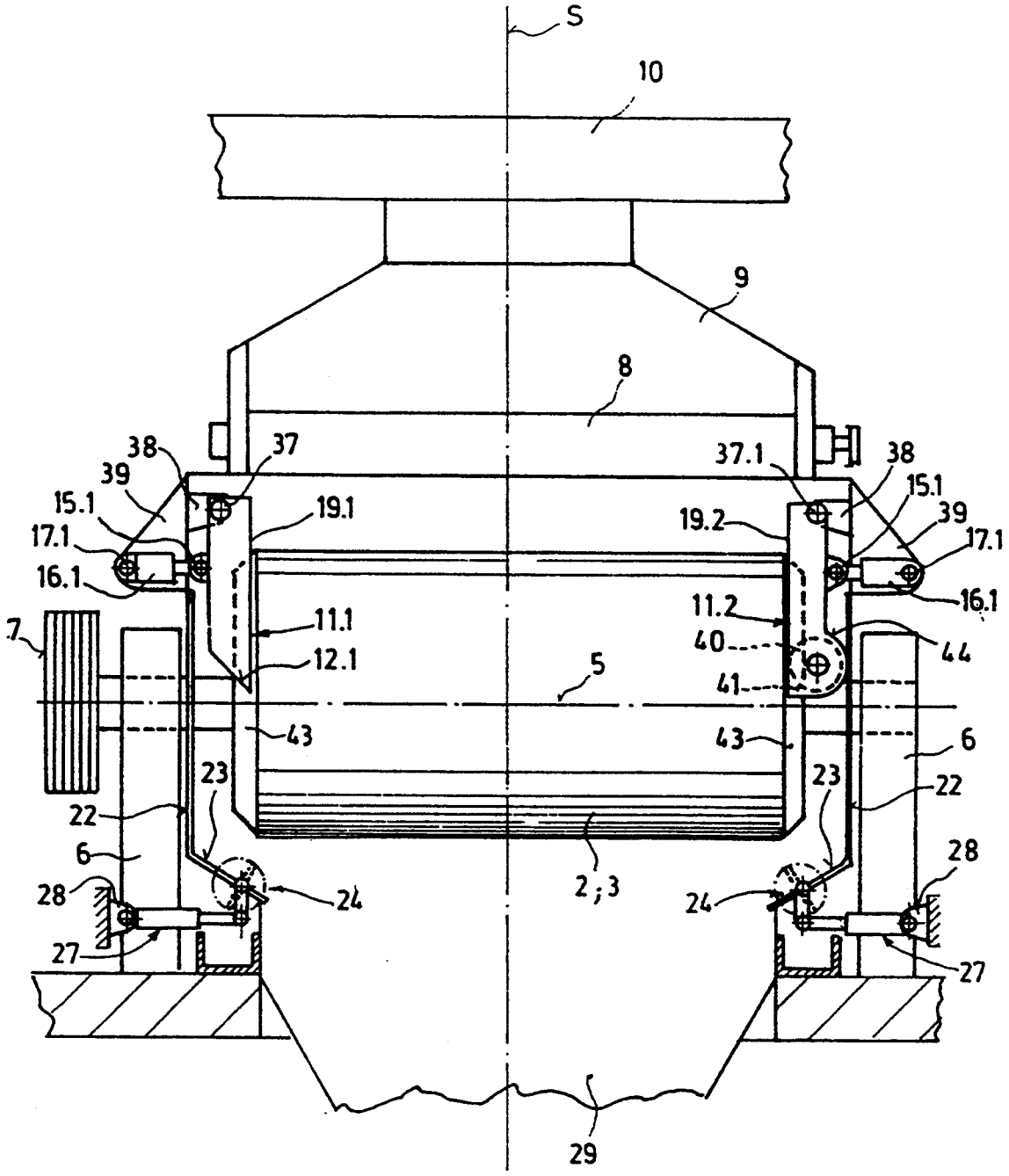
FIG. 2 is a further embodiment of the roll mill shown in FIG. 1.

FIG. 2 shows in its left portion, that is left of the vertical plane of symmetry S, a variation or further embodiment of rocker arm 11, which is denominated here as rocker arm 11.1 which together with a guide surface 12.1 and a product guide or channel 19.1 constitutes a unitary piece, which is not stationary but pivotable as a whole, via a pivot bearing 37 arranged on a stationary housing portion 38. In the position, shown in the left portion of FIG. 2, rocker arm 11.1 and product guide 19.1, that is in their operating position, these elements have the same function as rocker arm 11 and product guide 19 of FIG. 1.

The means for actuating rocker arm 11.1 and product guide 19.1 takes the form of a piston-cylinder unit 16.1 which is attached to product guide 19.1 via a pivot axis 15.1 and to stationary housing portion 39 via a pivot bearing 17.1. Therefore, these parts are denominated the same as in FIG. 1, but with the addition of the suffix or index of 0.1.

Similarly, the right portion of FIG. 2, that is right of the vertical plane of symmetry S, the means for actuating is the same as that just previously described. Here, a rocker arm 11.2, has a guide surface 41, which is a portion of a guide roll 40, which in turn is rotatably arranged on rocker arm 11.2. Guide surface 41 has the same function as guide surfaces 12 and 12.1.

Rocker arm 11.2 includes product guide or channel 19.2 which has the same function as product guide 19.1, shown on the left hand portion of FIG. 2. Rocker arm 11.2, inclusive of product guide 19.2, is pivotally journalled in stationary housing portion 38 via a pivot bearing 37.1.

As can be seen more clearly in the larger scale of FIG. 4, rocker arm 11.2, including guide roll 40 is surrounded by a cover portion 44 whose function it is to prohibit that the product can flow without being milled behind the rocker arm and thereby past roll gap 4 at the side of rolls 2 and 3 into a collector funnel 29 (FIGS. 1 and 2).

Figure 5:
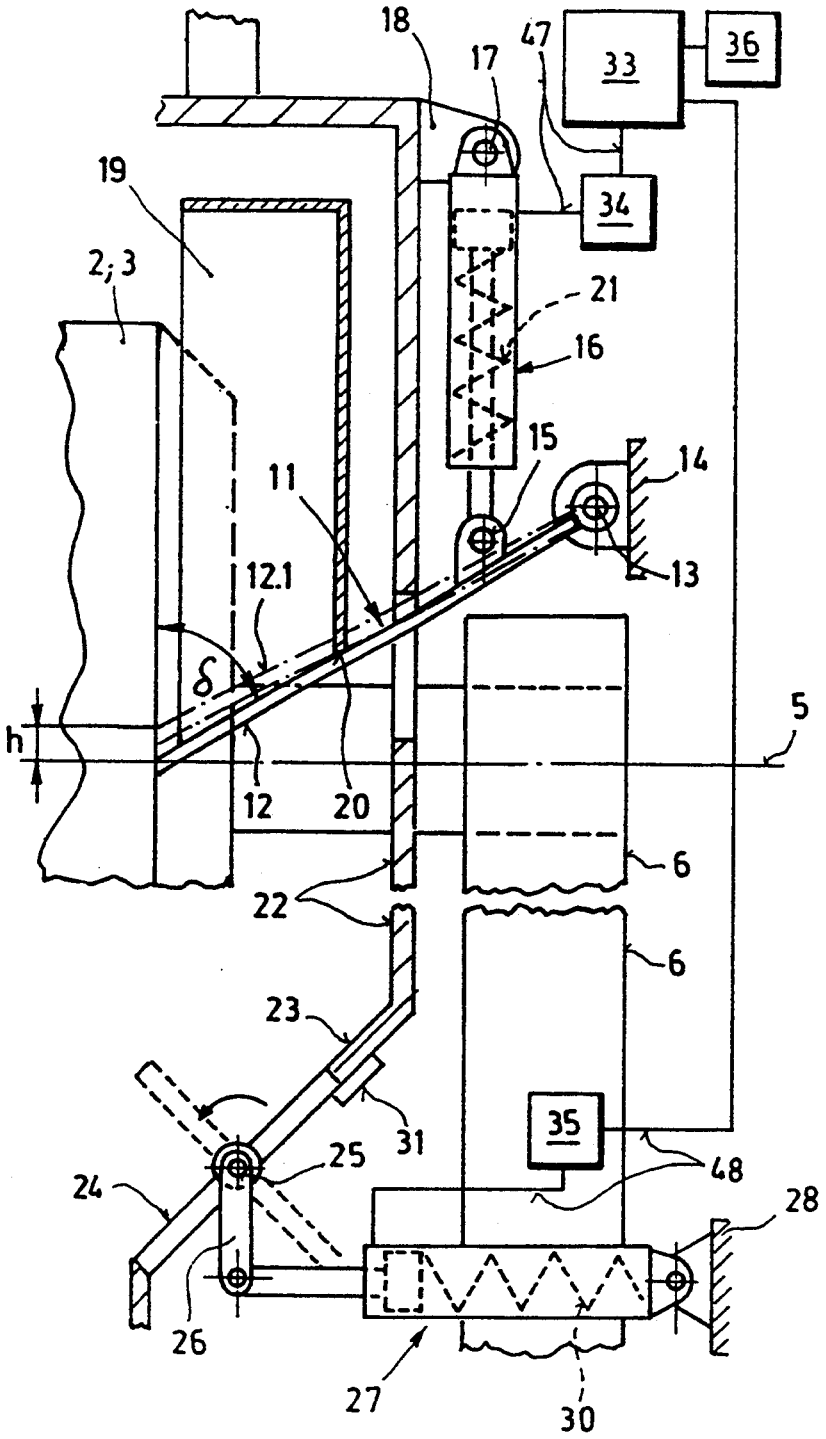
FIG. 5 is a cutaway portion of FIG. 1 showing additional details thereof both schematically and partially in section.

FIG. 5 shows, at a larger scale, the right hand portion of the roll mill of FIG. 1, with the addition of a schematically illustrated control system 33, which so controls piston-cylinder unit 16, via a valve 34 and a pressure conduit 47, that links valve 34 with piston-cylinder unit 16, that spring 21 is compressed, thus pivoting rocker arm 11 in a counter clockwise direction. As a result, a channel having an included angle $\delta$ is formed which is open so far, during a predetermined short time period, that the material accumulated via guide surface 12 can move downwardly in the direction of rotary flap 24. At the same time, with the pivoting of rocker arm 11, rotary flap 24 is opened, so that the previously noted, accumulated material on guide surface 12 can flow into collector tray 46.

A piston-cylinder unit 27 is so pressure actuated, via a valve 35 operatively interconnected with control system 33 by a pressure conduit 48, that spring 30, within piston-cylinder unit 27, is compressed, whereby rotary flap 24 is pivoted in the counter clockwise direction and thus opened. Piston-cylinder unit 27 is pivotally secured on a stationary housing portion 28.

Guide surface 12 or 12.1 can be designed either as shown in the solid lines or, in the broken lines, which means that the end of guide surface 12 or 12.1, which extends towards rolls 2, 3, can have a space or distance h opposite to an imaginary plane containing the axes 5 and the narrowest gap between rolls 2 and 3. The differing result of the two placements of guide surface 12 and 12.1 will be described in more detail hereinafter during the explanation of FIGS. 7 and 7*a*.

Control system 33 can be so designed that rocker arm 11 together with rotary flap 24 is opened at a predetermined cycle, that is at a predetermined time interval, or a timer 36 can be utilized by means of which the cycle can be variably set.

In addition, there is an embodiment wherein the piston-cylinder unit 16 is so equipped that the movement of the piston can be measured, for example using the well known Sacol Hydraulic Actuators fitted with a one hundred micron linear displacement transducer, so that an item, located on guide surface 12, which is significantly heavier than the product, causes even a minimal movement of the piston of piston-cylinder unit 16, and that this movement is noted by the measuring system and fed as a signal to control system 33, which thereafter causes an opening or movement of rocker arm 11. This control principle can be utilized for all noted variations with rocker arms 11, 11.1 and 11.2.

There is also an embodiment wherein guide surface 12 or 12.1 is equipped with any desired type of a strain gauge (not shown), which ascertains a gradual even if minimal deflection of these guide surfaces, which, if it is outside of a predetermined tolerance band, sends a signal to control system 33 in order to effect the previously-noted opening or movement of rocker arm 11 or 11.1.

Figure 6:
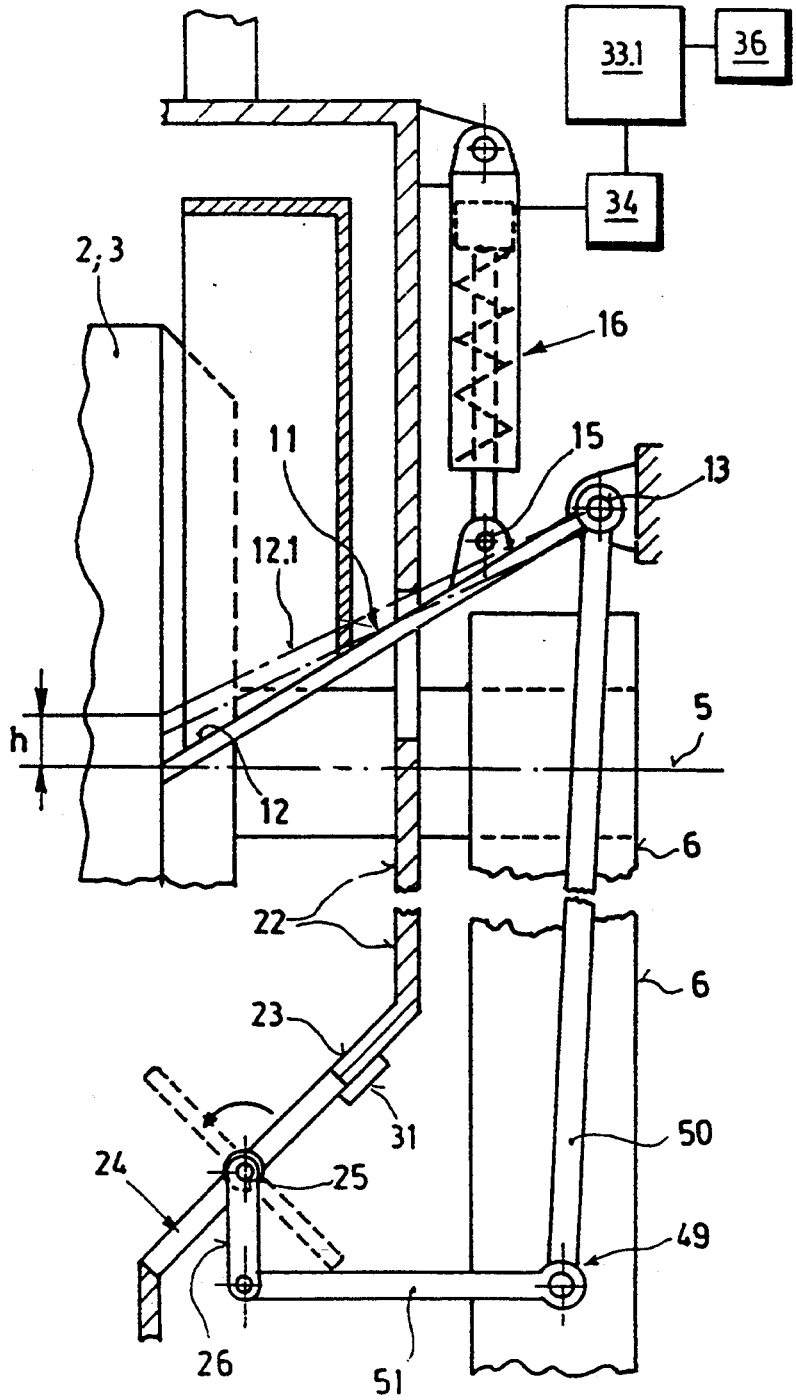
FIG. 6 is a variation of the cutaway view of FIG. 5.

FIG. 6 shows a variation of the arrangement of FIG. 5 wherein pivot lever 26 is pivoted via a universal-type elbow joint 49, whereby a toggle joint 51 of universal-type elbow joint 49 is pivotally connected with pivot lever 26 and on the other end a toggle joint 50 of universal-type elbow joint 49 is fixedly connected with pivot bearing 13.

When rocker arm 11 is pivoted in the counter clockwise direction, by reason of the previously-noted connection via universal-type elbow joint 49, rotary flap 24 is also, as indicated by the arrow, pivoted in the counter clockwise direction, so that the material released by rocker arm 11 is transferred to collector tray 46 shown in FIG. 1. The additional shown elements, corresponding with those of FIG. 5, are denominated with the same numbers and will not be discussed further.

Figure 7:
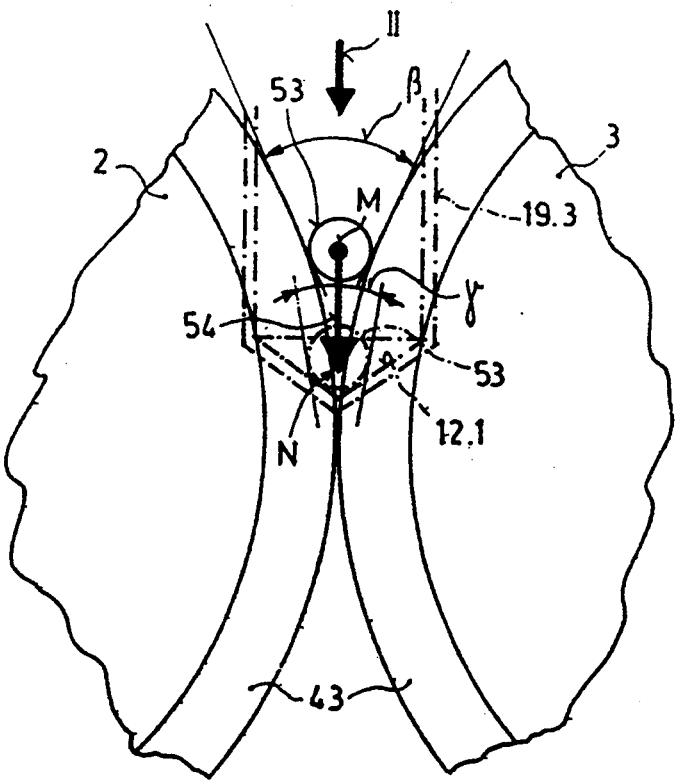
FIG. 7 is a cutaway portion of the roll mill according to FIG. 1.
Figure 7A:
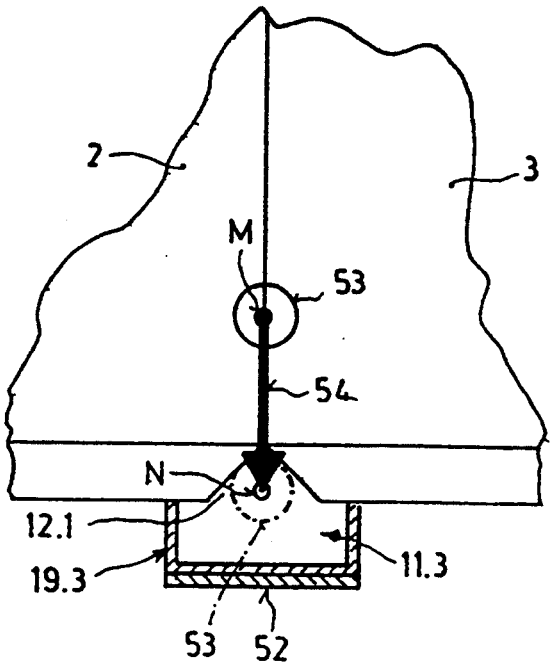
FIG. 7*a* is a top plan view of FIG. 7 looking in the direction of arrow II.

FIGS. 7 and 7*a* show how coarse impurities, that is those which are not pulled into the narrowest gap between the rolls, are handled. In FIGS. 7 and 7*a*, a coarse impurity is denominated by numeral 53, and as shown in FIG. 7, as a result of the position of coarse impurity 53 in the roll gap, an entrance angle $\beta$ results, which is formed by the tangents of the contact lines or contact points of the coarse impurities at the rolls. FIG. 7*a* also shows the coarse impurity that is shown in position M in FIG. 7 and the bold extended arrow 54 illustrates that the coarse impurity, as described earlier, gravitates toward the ends of rolls 2 and 3 into the position N.

In position N, as shown in FIG. 7, as a result of frusto-conical tapered ends 43, coarse impurity 53 is in a lower position, when viewing FIG. 7, in which an entrance angle $\gamma$ is present which is, as is seen in FIG. 7, smaller than entrance angle $\beta$. The space or distance h, shown in FIGS. 5 and 6, is so empirically chosen, that a coarse impurity, which resides on guide surface 12.1 has an entrance angle $\gamma$, which is sufficiently small so as to produce friction between coarse impurity 53 and tapered roll ends or areas 43, which is sufficiently large, that via this frictional force, a springy or elastic rocker arm 11.3, shown in FIGS. 8 and 8*a*, is bent or deflected downwardly so that the coarse impurity can fall into the region below rolls 2 and 3.

On the other hand, when the rocker arm is operated via actuating means, as is the case in the embodiments shown in FIGS. 1–6, coarse impurity 53 is transferred to the noted region underneath rolls 2 and 3 only when rocker arm 11 or 11.1 or 11.2 is tilted downwardly.

Figure 8:
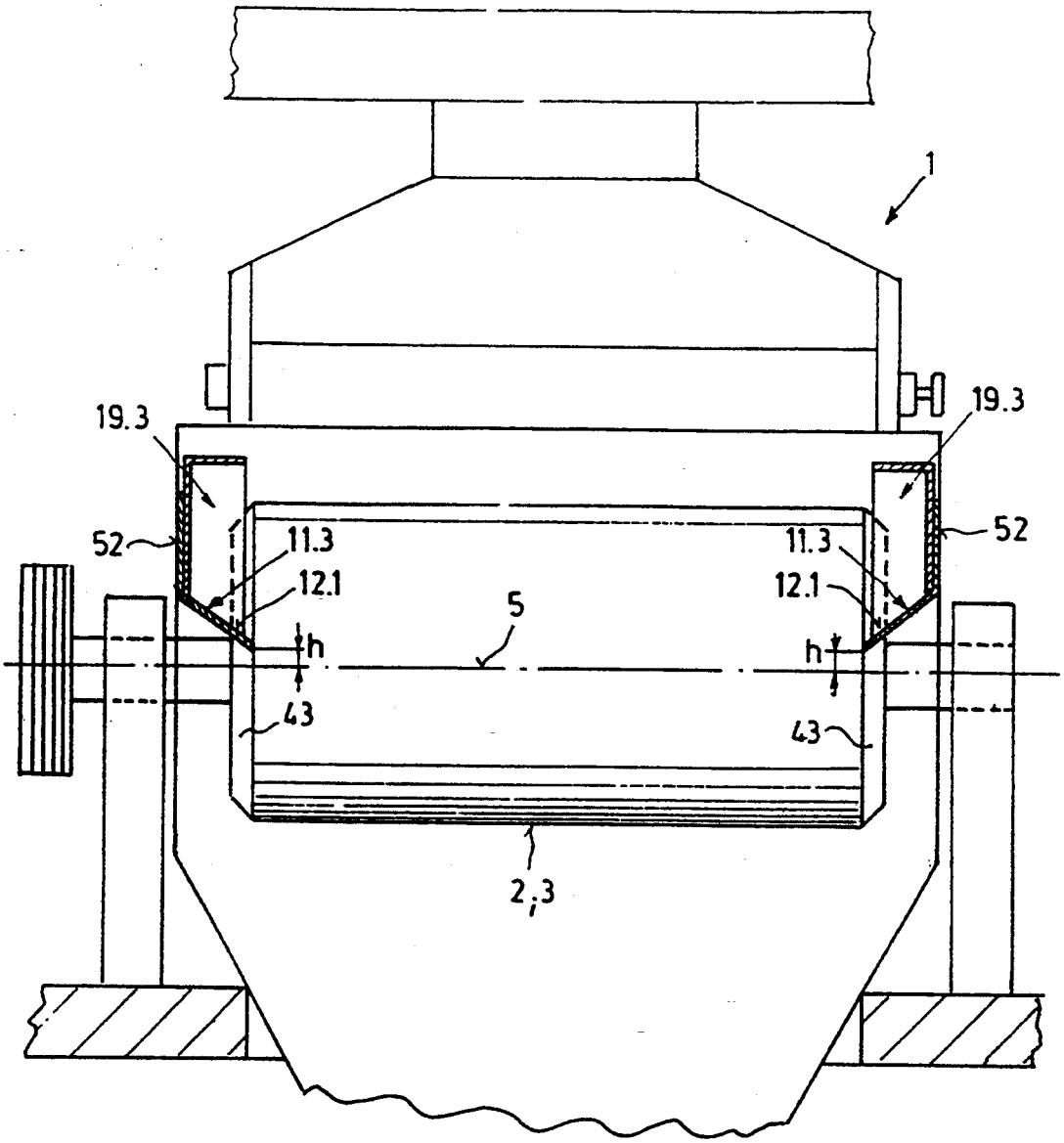
FIG. 8 is roll mill according to FIG. 1, however including an embodiment, in section, of the present invention.

In FIG. 8, an elastically deformable or springy rocker arm 11.3 is provided with a plate portion 52 which is fixedly connected with product guide 19.3 which in turn is also fixedly arranged. Rocker arm 11.3 adjoins the sidewalls of product guide 19.3 with an empirically determined prestress or preload and closes off lower open portion of the product guide until a coarse impurity 53 overcomes the spring force of rocker arm 11.3.

Figure 8A:
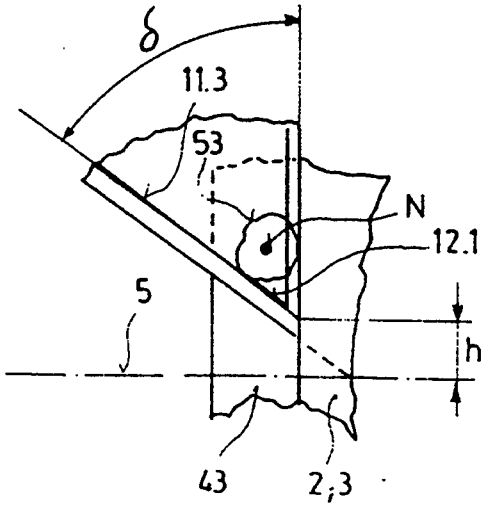
FIG. 8*a* is a cutaway portion of the roll mill of FIG. 8.

The angle δ, indicated in FIG. 8*a*, illustrates the guide angle of all rocker arms 11 to 11.3 and can be selected empirically, for example between 30° and 80° preferably between 45° and 60°.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; and wherein the product channel is stationary and the rocker arm is elastically deformable and adjoins the product channel.

2. The flaking roller mill of claim 1, further including a pivotable flap, the flap being arranged below the product channel, means for controlling and actuating the pivotable flap so that the flap is in an operating position when the guide surfaces are also in the operating position and is pivotable into a discharge position when the guide surfaces are also in the discharge position, to thereby remove coarse impurities on the guide surfaces, from the roll mill by means of the flap.

3. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; and a pivotable flap, the flap being arranged below the product channel, means for controlling and actuating the pivotable flap so that the flap is in an operating position when the guide surfaces are also in the operating position and is pivotable into a discharge position when the guide surfaces are also in the discharge position, to thereby remove coarse impurities on the guide surfaces, from the roll mill by means of the flap.

4. The flaking roller mill of claim 3, further including means for pivoting the rocker arm and respectively the guide surfaces into the operating position and into the discharge position, said pivoting means taking the form of a single acting cylinder including an internal pressure spring, with the spring maintaining the guide surfaces in the operating position.

5. The flaking roller mill of claim 4, further including a control system having a timer for controlling the means for pivoting, with the pivot means actuating the rocker arm, at predetermined time intervals from the operating position into the discharge position.

6. The flaking roller mill of claim 4, further including a control system for controlling the means for pivoting, a strain gage is provided on the guide surface, with the strain gauge being operatively connected with the control system and providing a signal to the control system when coarse impurities of a minimal weight are present on the guide surface, with the control system, as a result of such a signal, causing the means for pivoting to pivot the guide surfaces from the operating position into the discharge position.

7. The flaking roller mill of claim 3, wherein the product channel is stationary and the rocker arm is pivotable and adjoins the product channel.

8. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; wherein the product channel is stationary and the rocker arm is pivotable and adjoins the product channel; and a pivotable flap, the flap being arranged below the product channel, means for controlling and actuating the pivotable flap so that the flap is in an operating position when the guide surfaces are also in the operating position and is pivotable into a discharge position when the guide surfaces are also in the discharge position, to thereby remove coarse impurities on the guide surfaces, from the roll mill by means of the flap.

9. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; wherein the product channel and the rocker arm are constructed as a single unit and are so movable as a unit that the guide surface is pivotable from the operating position to the discharge position; and further including a pivotable flap, the flap being arranged below the product channel, means for controlling and actuating the pivotable flap so that the flap is in an operating position when the guide surfaces are also in the operating position and is pivotable into a discharge position when the guide surfaces are also in the discharge position, to thereby remove coarse impurities on the guide surfaces, from the roll mill by means of the flap.

10. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; wherein the guide surface forms a portion of a guide roll, with the guide roll being rotatable on the product channel and being pivotable, together with the product channel from the operating position to the discharge position and back to the operating position; and further including a pivotable flap, the flap being arranged below the product channel, means for controlling and actuating the pivotable flap so that the flap is in an operating position when the guide surfaces are also in the operating position and is pivotable into a discharge position when the guide surfaces are also in the discharge position, to thereby remove coarse impurities on the guide surfaces, from the roll mill by means of the flap.

11. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; further including means for pivoting the rocker arm and respectively the guide surfaces into the operating position and into the discharge position, said pivoting means taking the form of a single acting cylinder including an internal pressure spring, with the spring maintaining the guide surfaces in the operating position.

12. The flaking roller mill of claim 11, further including a control system having a timer for controlling the means for pivoting, with the pivot means actuating the rocker arm, at predetermined time intervals from the operating position into the discharge position.

13. The flaking roller mill of claim 12, further including a control system having a timer for controlling the means for pivoting, with the pivot means actuating the rocker arm, at predetermined time intervals from the operating position into the discharge position.

14. The flaking roller mill of claim 11, further including a control system for controlling the means for pivoting, a strain gauge is provided on the guide surface, with the strain gauge being operatively connected with the control system and providing a signal to the control system when coarse impurities of a minimal weight are present on the guide surface, with the control system, as a result of such a signal, causing the means for pivoting to pivot the guide surfaces from the operating position into the discharge position.

15. The flaking roller mill of claim 11, further including a pivotable flap, the flap being arranged below the product channel, means for controlling and actuating the pivotable flap so that the flap is in an operating position when the guide surfaces are also in the operating position and is pivotable into a discharge position when the guide surfaces are also in the discharge position, to thereby remove coarse impurities on the guide surfaces, from the roll mill by means of the flap.

16. The flaking roller mill of claim 11, wherein the product channel and the rocker arm are constructed as a single unit and are so movable as a unit that the guide surface is pivotable from the operating position to the discharge position.

17. The flaking roller mill of claim 16, wherein the guide surface forms a portion of a guide roll, with the guide roll being rotatable on the product channel and being pivotable, together with the product channel from the operating position to the discharge position and back to the operating position.

18. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; wherein the product channel is stationary and the rocker arm is pivotable and adjoins the product channel; and further including means for pivoting the rocker arm and respectively the guide surfaces into the operating position and into the discharge position, said pivoting means taking the form of a single acting cylinder including an internal pressure spring, with the spring maintaining the guide surfaces in the operating position.

19. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; wherein the product channel and the rocker arm are constructed as a single unit and are so movable as a unit that the guide surface is pivotable from the operating position to the discharge position; and further including means for pivoting the rocker arm and respectively the guide surfaces into the operating position and into the discharge position, said pivoting means taking the form of a single acting cylinder including an internal pressure spring, with the spring maintaining the guide surfaces in the operating position.

20. A flaking roller mill for processing particles, comprising at least two rollers, the rollers being pressed against one another by means of a pressure device, with each of the axial ends of the rollers, having arranged, opposite to frontal areas of the rollers, a product channel, with each of the product channels having an inclined guide surface adapted for diverting those particles which tend to flow beyond the axial length of the rollers, back to a converging gap between the rollers, wherein the guide surfaces form a portion of a movable rocker arm so that the guide surfaces are movable from an operating position into a discharge position and back into the operating position; wherein the guide surface forms a portion of a guide roll, with the guide roll being rotatable on the product channel and being pivotable, together with the product channel from the operating position to the discharge position and back to the operating position; and further including means for pivoting the rocker arm and respectively the guide surfaces into the operating position and into the discharge position, said pivoting means taking the form of a single acting cylinder including an internal pressure spring, with the spring maintaining the guide surfaces in the operating position.

* * * * *